US005820022A

United States Patent [19]

Fukano et al.

[11] Patent Number: 5,820,022

[45] Date of Patent: Oct. 13, 1998

[54] FOUNTAIN APPARATUS

[75] Inventors: Fujie Fukano, Tokyo; Kouei Yamazaki, Hachioji, both of Japan

[73] Assignee: Water Pearl Co., Ltd., Tokyo, Japan

[21] Appl. No.: 722,888

[22] Filed: Sep. 23, 1996

[30] Foreign Application Priority Data

Sep. 21, 1995 [JP] Japan ..... 7-242742
Dec. 27, 1995 [JP] Japan ..... 7-340575

[51] Int. Cl.[6] ..... B05B 17/08

[52] U.S. Cl. ..... 239/17; 239/101

[58] Field of Search ..... 231/102.1, 102.2, 231/101, 11–20, 99, 97, 588

[56] References Cited

U.S. PATENT DOCUMENTS

| | | | |
|---|---|---|---|
| 3,387,782 | 6/1968 | Mizuno | 239/20 |
| 3,469,785 | 9/1969 | Boucher et al. | 239/4 |
| 3,595,479 | 7/1971 | Freeman | 239/102.1 |
| 4,265,402 | 5/1981 | Tsai | 239/102.1 |
| 4,294,406 | 10/1981 | Pevnick | 239/20 |
| 4,393,991 | 7/1983 | Jeffras et al. | 239/102.2 |
| 5,152,210 | 10/1992 | Chen | 239/18 |

FOREIGN PATENT DOCUMENTS

| | | | |
|---|---|---|---|
| 60-4975 | 1/1985 | Japan . | |
| 4-145297 | 5/1992 | Japan . | |
| 404132102 | 5/1992 | Japan | 239/18 |
| 4-191786 | 7/1992 | Japan . | |

*Primary Examiner*—Kevin Weldon
*Attorney, Agent, or Firm*—Lowe Hauptman Gopstein Gilman & Berner

[57] ABSTRACT

A fountain apparatus includes a vibration imparting device disposed midway in a water passage pipe and a plurality of nozzles connected to a distal end of the water passage pipe on the downstream side of the vibration imparting device. The water spouting from the nozzles appears as drops of water due to vibrations from the vibration imparting device. The vibration imparting device has a diaphragm at the bottom of a tank, and the diaphragm suspends and holds a vibrator. When the diaphragm is vibrated by the vibrator, the vibrations propagate through the flowing water, and produces drops of water when the water spouts from an opening in each nozzle. The aperture of each nozzle exceeds 3 mm in diameter, and the diameter of the drops of spouting water exceeds 6 mm.

6 Claims, 7 Drawing Sheets

FOUNTAIN APPARATUS

BACKGROUND OF THE INVENTION

1. Field of the Invention

The present invention relates to a fountain apparatus, and more particularly to a fountain apparatus with a simple construction which is capable of increasing the diameter of drops of water spouting intermittently from tips of nozzles, and which is capable of producing a decorative effect in a clearly visible form.

2. Description of the Related Art

Conventionally, a method and a structure are known in which when water is supplied to a water passage pipe by using a water storage section or a faucet of water supply as the source of water supply, and water is made to spout from a nozzle connected to a distal end of the water passage pipe, vibrations are imparted by a vibration imparting means called a water sound generator disposed midway in the water passage pipe, thereby to intermittently spout drops of water from a tip of the nozzle (e.g., refer to Japanese Patent Application Laid-Open Nos. 4975/1975 and 191786/1992).

In the aforementioned method, a technique is adopted in which a vibration (in-water sound) imparting means of a predetermined frequency is provided midway in a water passage pipe, and a diaphragm constituting the vibration imparting means vibrates vertically to generate vibrations (sound) in the water. In this method, the vibrations propagate through the flowing water, and when the vibrations have reach a tip of a nozzle whose aperture is throttled, dense portions of the vibrations strongly act on the flowing water to activate the motion of molecules of water, and such portions whose molecular motion is activated, when spouting from the nozzle opening, appear as drops of water. This method is specifically used in a fountain apparatus. As shown in Japanese Patent Application Laid-Open No. 145297/1992, this fountain apparatus is arranged such that one end of the water passage pipe is connected to a water storage section, a nozzle is connected to the other end of the water passage pipe, a pump, a filter, and the vibration imparting means are interposed midway in the water passage pipe, and a multi-strobe is disposed at an upper side of the fountain apparatus. When the multi-strobe is made to flash, the drops of water can be seen clearly by virtue of the afterimage effect of the human eyes. Further, as the flashing frequency of the multi-strobe is adjusted by being increased or decreased, the stationary, dropping, and rising states of the drops of water can be expressed.

As specifically shown in Japanese Patent Application Laid-Open No. 191786/1992, the vibration imparting means is arranged such that a hollow body is formed by a lower body connected to a water supply pipe as well as an upper body connected to an upper portion of the lower body, and a diaphragm at its periphery is secured in the interior of the hollow body. A vibrating coil is suspended from a lower central portion of the diaphragm, and this vibrating coil is disposed at a position at which the vibrating coil surrounds the core of a permanent magnet disposed in face-to-face relation thereto. Accordingly, as a predetermined power supply is turned on to energize the vibrating coil, the vibrating coil, and hence, the diaphragm, become vertically vibratable, which is one principle which produces the drops of water.

However, the tip of the nozzle in the conventional fountain apparatus has an aperture whose upper limit is 3 mm. The size of the spouting drops of water is about twice as large as the aperture. Hence, the limit of the diameter of the drops of water spouting from the nozzle tip has been 6 mm at best. For this reason, there has been a drawback in that although, when the spouting state of the drops of water is appreciated from a close place, the presence of the drops of water can be recognized, it is difficult to clearly recognize the spouting state of the drops of water from a place remote from the fountain apparatus, appreciably undermining the intended decorative effect. In this case, it theoretically suffices if the aperture of the nozzle is set to be large, but if the aperture is merely enlarged, a critical problem arises in that the drops of water become broken. Conceivably, this is due to the fact that there is a factor which hampers the formation of satisfactory drops of water in the correlation with the vibration imparting means and the like.

In addition, with the above-described vibration imparting means, there has been a drawback in that since the structure is such that the weight of the water in the aforementioned hollow body and the water in the water passage pipe extending from the hollow body is added to the diaphragm, the diaphragm tends to expand downward and the vibrating coil tends to abut against the permanent magnet, thereby making it impossible for the diaphragm to vibrate vertically. Accordingly, with the conventional structure, the water passage pipe extending from the vibration imparting means must be made short to control the weight of the load for the diaphragm. Hence, there is a problem in that such a fountain apparatus cannot be used as a fountain apparatus for expressing various variations of use with its water passage pipe extended long.

In addition, with the above-described vibration imparting means, the number of component parts used is large, and the overall structure becomes complicated, resulting in the drawback that the cost of manufacturing the vibration imparting means becomes high.

SUMMARY OF THE INVENTION

The present invention has been devised in view of the above-described drawbacks of the conventional art, and it is an object of the present invention to provide a fountain apparatus which is capable of producing a decorative effect in a clearly visible form by enlarging the diameter of spouting drops of water, in which the diaphragm in the vibration imparting means can be constantly vibrated stably with large amplitude, and which makes it possible to realize various forms of use by allowing the distance from the vibration imparting means to the nozzle to be set to be long.

Another object of the present invention is to provide a fountain apparatus which is capable of producing large drops of water even if the structure of the vibration imparting means is made very simple, thereby attaining a substantial reduction in manufacturing cost and construction cost.

Accordingly, in the fountain apparatus in the present invention, an arrangement is adopted in which a diaphragm is provided at a part of a tank which forms a single chamber, and a vibrator unit is connected to the diaphragm, and an additional arrangement is adopted in which the vibrator is connected directly or indirectly to a hose.

To attain the above objects, in accordance with the present invention, there is provided a fountain apparatus comprising: vibration imparting means for imparting vibrations to flowing water and including a tank which forms a single chamber, a diaphragm disposed at a part of the tank, and a vibrator unit connected to the diaphragm and adapted to impart vibrations of a predetermined frequency to the diaphragm; and a nozzle through a tip of which the water with the vibrations imparted thereto by the vibration imparting means spouts in the form of drops of water. In the fountain apparatus arranged as described above, as the diaphragm vibrates, dense portions of the vibrations are produced in the water in the tank in correspondence with the frequency. Then, when the dense portions of the vibrations are propagated through the flowing water and spouts from the nozzle tip, that portion of water spouts intermittently as drops of water. This diaphragm is vibrated directly by the vibrator unit, and the weight of water applied to the diaphragm can be added to the vibrations, so that it is possible to continue a stable state of occurrence of drops of water.

As for the diaphragm in the above-described fountain apparatus, an arrangement is preferably adopted in which the diaphragm is formed by a resin, metal, or rubber plate having a thickness of 0.5 mm to 5 mm, and the tip of the nozzle has an aperture of more than 3 mm and not more than 20 mm. Since a diaphragm having a thickness of 0.5 mm to 5 mm is used, the diaphragm does not undergo a large deformation even if the weight of water is applied thereto. Accordingly, the diaphragm can be vibrated reliably in this respect as well. In addition, if the nozzle whose aperture is set in the aforementioned range is used, it is possible to produce drops of water whose diameter exceeds at least 6 mm, so that the drops of water can be discerned even from a distant place.

Further, an arrangement is adopted in which a plurality of nozzles are combined as the nozzle, a water distributing member communicating with a source of water supply is disposed at proximal end sides of the nozzles, and hoses in a number corresponding to the number of the nozzles are interposed between the water distributing member and the nozzles. Accordingly, the spouting range of the drops of water can be enlarged, and in terms of appearance it is possible to obtain a spouting form resembling the form of a waterfall.

Additionally, an arrangement is also adopted in which the vibrator unit of the fountain apparatus is held by being suspended from the diaphragm. Since the vibrator unit is made a non-fixed type, the vibrations of the vibrator unit can be directly transmitted to the diaphragm.

Further, in accordance with the present invention, there is provided a fountain appearance comprising: vibration imparting means for imparting vibrations to flowing water and including a vibrator unit; and a nozzle through a tip of which the water with the vibrations imparted thereto by the vibration imparting means spouts in the form of drops of water, wherein the vibrator unit is connected directly or indirectly to the nozzle. According to this arrangement, the structure of the vibration imparting means itself can be simplified, so that a compact apparatus can be realized. At the same time, it is possible to attain a reduction in the manufacturing cost and construction cost, and enlarge the versatility of the fountain apparatus. Incidentally, the tip of the nozzle in this fountain apparatus also has an aperture of more than 3 mm and not more than 20 mm, so that it is possible to produce large drops of water. Further, it is preferable to adopt an arrangement in which a plurality of nozzles are provided as the nozzle, hoses in a number corresponding to the number of the nozzles are connected to proximal end sides of the nozzles, and the hoses are connected to a water distributing member communicating with a source of water supply. Such an arrangement easily permits the free layout of the position of nozzles.

Furthermore, in accordance with the present invention, there is provided a fountain apparatus comprising: vibration imparting means for imparting vibrations to flowing water and including a vibrator unit; and a nozzle through a tip of which the water with the vibration imparted thereto by the vibration imparting means spouts in the form of drops of water, wherein a hose is connected to a proximal end side of the nozzle, and the vibrator unit is connected directly or indirectly to the hose.

The nozzle aperture in the present invention is set in a range of more than 3 mm and not more than 20 mm, but is preferably set in a range of 4 mm to 8 mm. The reason for this is that if the nozzle aperture is 3 mm or less, the diameter of the drops of water is 6 mm or thereabouts at maximum, and it is impossible to obtain drops of water large enough to produce the decorative effect in a clearly visible form. On the other hand, if the nozzle aperture exceeds 20 mm, the drops of water are liable to break, so that it is difficult to produce the drops of water on a stable basis.

As the hose which is disposed between the nozzle and the water distributing member, a flexible hose made of a resin, e.g., silicone, is used. In addition, in the present invention, it is possible to adopt an arrangement in which the hose is directly connected to the tank without providing the water distributing member, and the nozzle is connected to a distal end of the hose.

The frequency of the vibrator unit is set in the range of 30 to 100 Hz, preferably 40 to 80 Hz. The reason for this is that if the frequency is less than 30 Hz, it is impossible to form drops of water. On the other hand, if the frequency exceeds 100 Hz, the drops of water run onto each other and form a continuous flow. In addition, the diaphragm is formed of a plastic or a metal plate. At this juncture, the thickness of the diaphragm is preferably set arbitrarily in the range of 0.5 to 5 mm. The vibrator unit used in the present invention generally includes those which are capable of vibrating with the aforementioned range of frequency, and its vibrating principle is not particularly limited. For instance, it is possible to use not only a type in which vibrations are produced by the rotation of a motor, but also a type in which vibrations are produced on the basis of the principle of a loudspeaker and the excitation of a coil. The vibrator unit is used for the effect of producing drops of water, and by appropriately adjusting its frequency, it is possible to select various forms in which the drops of water can be shown as being stationary, dropping, or rising in the same way as the aforementioned multi-strobe. Incidentally, if it is assumed that the drops of water can be seen as being stationary when the flashing frequency of the multi-strobe is fixed and the frequency of the vibrator unit is 50 Hz, the drops of water can be seen as dropping at the frequency of 51 Hz or more, and rising at the frequency of 49 Hz or less.

Hollow members having such as a hollow cylindrical shape, a hollow prismatic shape, or the like are used as the tank of the vibration imparting means and the water distributing member, and such members may be provided with inside diameters of various dimensions.

The above and other objects, features and advantages of the present invention will become more apparent from the following detailed description of the invention when read in conjunction with the accompanying drawings.

DESCRIPTION OF THE PREFERRED EMBODIMENTS

Referring now to the accompanying drawings, a description will be given of the embodiments of a fountain apparatus in accordance with the present invention.

Figure 1:
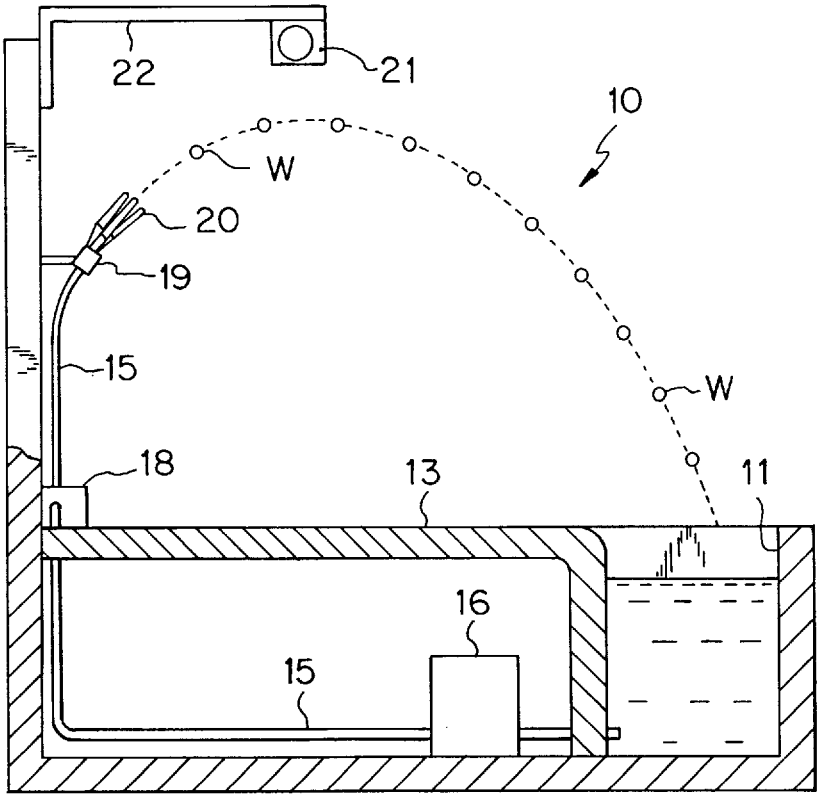
FIG. 1 is a schematic diagram illustrating a first embodiment of the fountain apparatus in accordance with the present invention.
Figure 2:
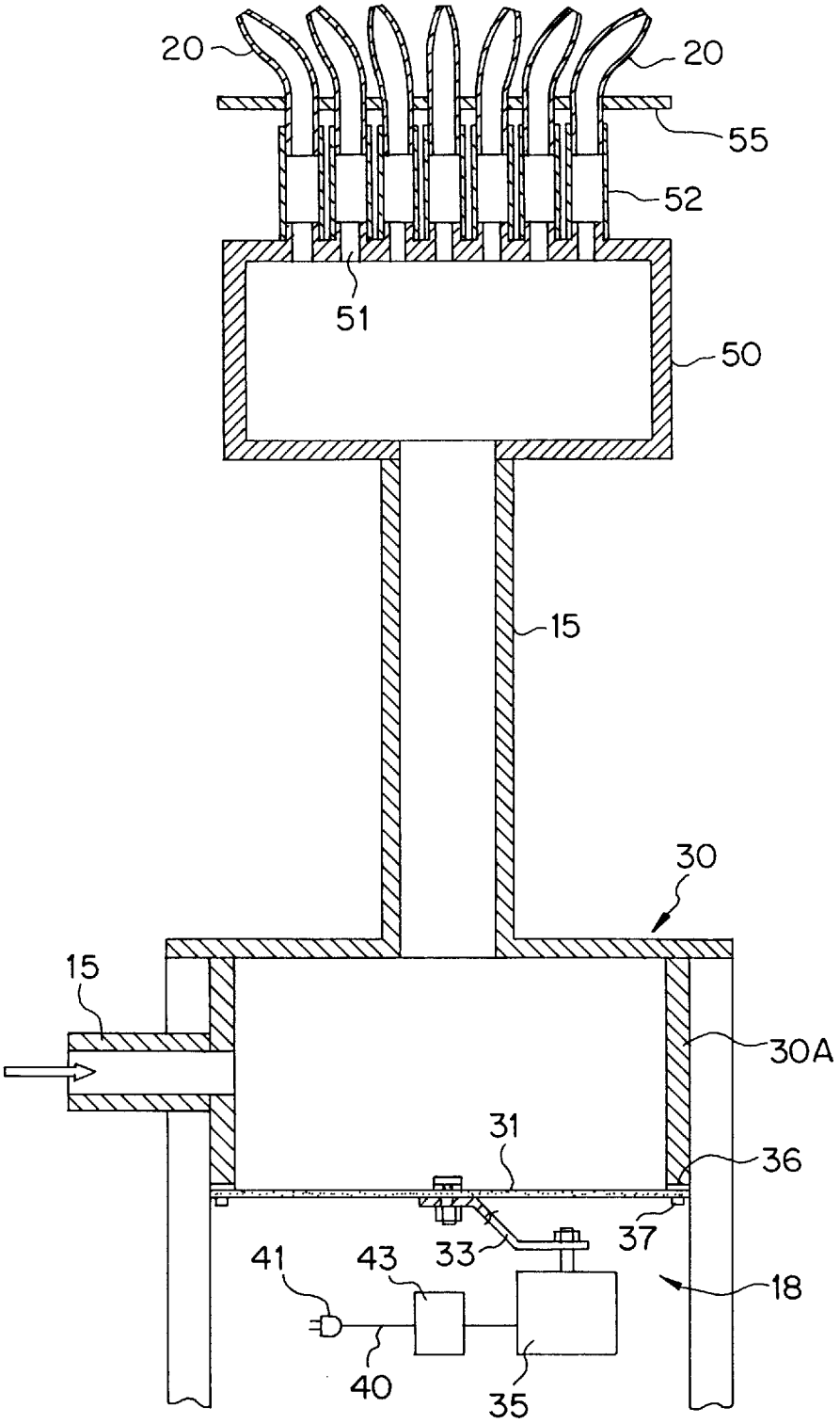
FIG. 2 is an enlarged cross-sectional view of an essential portion of the fountain apparatus shown in FIG. 2.

FIG. 1 shows a schematic configuration of the fountain apparatus in accordance with a first embodiment, and FIG. 2 shows an enlarged cross-sectional view of an essential portion thereof. In these drawings, a fountain apparatus 10 comprises a water storage section 11 for constantly accommodating water of a predetermined capacity. A water passage pipe 15 whose one end communicates with the water storage section 11 is disposed inside a cover 13 provided at a position adjacent to the water storage section 11. A pump 16, which is constituted by a gear pump or the like, is disposed midway in the water passage pipe 15. Further, the other end side of the water passage pipe 15 extends upward through a vibration imparting means 18 provided on the cover 13. A plurality of nozzles 20 are connected to a distal end of the water passage pipe 16 through a nozzle tank 19 serving as a water distribution member. Here, vibrations at a predetermined frequency, e.g., 50 Hz, are imparted to water flowing through the water passage pipe 15 by the vibration imparting means 18, and as the vibrations are transmitted to the flowing water, it is possible to allow drops of water W to spout from the nozzles 20. Light is applied to the drops of water W by a multi-strobe 21 which is supported at an upper position by an arm 22, so that the drops of water W which spouted in the air can be vividly perceived.

As shown in FIG. 2, the vibration imparting means 18 is comprised of a hollow cylindrical tank 30 which is interposed between sections of the water passage pipe 15 and forms a single chamber; a diaphragm 31 disposed on the bottom side of the tank 30; an arm 33 whose one end is connected to the diaphragm 31; and a vibrator unit 35 which is connected to the other end of the arm 33. In this embodiment, a tank having an inside diameter of approximately 200 mm is used as the tank 30, while a polyvinyl chloride resin plate having a thickness of 2 mm is used as the diaphragm 31. At this time, the diaphragm 31 is secured to a lower end face of a peripheral wall 30A of the tank 30 by means of a rubber-based adhesive 36 and bolts 37.

The vibration unit 35 is held by being suspended from the diaphragm 31 in a state in which the vibrator 35 is connected to the arm 33. That is, the vibrations of the vibrator unit 35 are transmitted only to the diaphragm 31 without being fixed to a member which serves as a base. A plug 41 is connected to a distal end of the vibrator unit 35 through a cable 40, and a frequency converter 43 is provided midway in the cable 40, as required. The frequency converter 43 variably adjusts the frequency of the vibrator unit 35, as required, with the result that a spouting interval of the drops of water W can be varied. Accordingly, if a case in which the drops of water W are produced by setting the vibration frequency of the vibrator 35 as 50 Hz is used as a standard, when the set frequency of the frequency converter 43 is set to, for example, 30 Hz, the spouting interval of the drops of water W becomes large, while if the frequency is set to 80 Hz, the spouting interval becomes short.

The vibrator unit 35 is of a type which is operated by electric power from a commercial power supply. Hence, the plug 41 can be directly inserted into a socket outlet in a general household, so that it is possible to generate large vibrations as compared with a case where the voltage is lowered by using an adapter or the like. Consequently, it is possible to reliably form the drops of water W even if the aperture of the nozzles 20 is made large.

The inside diameter of the water passage pipe 15 projecting from the upper portion of the tank 30 is set to approximately 20 mm, and a nozzle tank 50 serving as a water distributing member having a hollow cylindrical shape with an inside diameter of approximately 200 mm is provided at an upper end of the water passage pipe 15. In other words, the nozzle tank 50 is formed with an inside diameter substantially identical to that of the tank 30. In addition, the plurality of nozzles 20 are attached to an upper end of the nozzle tank 50. The nozzles 20 in this embodiment are respectively attached by means of silicone rubber-made hoses 52 which are secured to an upper end opening 51 of the nozzle tank 50. The nozzles 20 are supported by being passed through a nozzle fixing plate 55, which is fixed to an unillustrated fixing side. Incidentally, although, in FIG. 2, the hoses 52 are each shown as having a hollow cylindrical shape extending straightly, the inside diameter of an upper portion of each hose 52 is, in reality, slightly expanded in its area where a proximal end of the nozzle 20 is fitted.

The nozzle 20 are formed of a synthetic resin such as polypropylene, and the aperture of the distal end of each nozzle 20 is set to 8 mm. If the drops of water W are actually spouted through the aperture of the nozzles 20, it is possible to produce drops of water W with a 16-mm diameter which is about double the size of the aperture. Accordingly, if nozzles having a 4-mm aperture are used, the diameter of the drops of water W becomes approximately 8 mm, and if nozzles having a 20-mm aperture are used, the diameter of the drops of water W becomes approximately 40 mm.

Next, a description will be given of the operation of the fountain apparatus 10 in accordance with this embodiment.

As the pump 16 is operated after turning on a predetermined power supply, water in the water storage section 11 passes through the water passage pipe 15 and continually spouts from the nozzle 20. Here, if the vibrator unit 35 is turned on to impart vibrations to the diaphragm 31, dense portions of the vibrations are propagated through the flowing water in correspondence with the vibrations, and the drops of water W are produced when the such water spouts from the openings of the nozzle 20.

Here, if light is applied to the drops of water W from the multi-strobe 21, the drops of water W can be visually perceived clearly in a state of being illuminated in spots and dropping along a parabola by virtue of the afterimage effect of the human eyes. At this juncture, the size of the drops of water W is approximately 16 mm in diameter, so that the drops of water W can be discerned even from a remote place.

Accordingly, in accordance with such an embodiment, it is possible to obtain the advantage that the diameter of the spouting drops of water W can be made larger than that in a conventional structure since the diaphragm 21 is made to vibrate with large amplitudes to propagate the vibrations to the flowing water, and since the aperture of the nozzles 20 is set to be large. For this reason, it is possible to obtain a favorable decorative effect even when the drops of water W of the fountain apparatus 10 are appreciated from a position remote from the fountain apparatus 10.

In addition, since the vibration imparting means 18 is constructed such that the diaphragm 31 is provided on the bottom side of the tank 30 having a single chamber and the vibrations are imparted to the diaphragm 31 by the vibrator unit 35, the structure is made very simple, and it is possible to reliably overcome the drawback of the conventional structure in which vibrations are imparted by a vibrating coil and a permanent magnet. That is, although a drawback has conventionally occurred in which the occurrence of the drops of water W is made impossible due to the contacting of the coil and the magnet, in this embodiment such a drawback is eliminated. In addition, even if the water passage pipe 15 which is present between the tank 30 and the nozzle tank 50 is made long, it is possible to overcome the problem of the diaphragm 31 becoming unable to vibrate due to the weight of the water. Therefore, it becomes possible to install the nozzles 20 at a desired position remote from the tank 30, and the spouting position of the fountain apparatus can be arbitrarily made different.

Further, in the above-described embodiment, the vibrator unit 35 is held being being suspended, whereby the vibrations of the vibrator unit 35 can be reliably imparted to the diaphragm 31. In addition, since the arrangement provided is such that the nozzles 20 are supported by the hoses 52, the opening directions of the nozzles 20 can be adjusted appropriately, thereby facilitating the adjustment of the directions in which the drops of water W spout.

Next, a description will be given of embodiments of the present invention other than the above-described embodiment. Incidentally, in the description that follows, those component parts which are identical or equivalent to those of the above-described first embodiment will be noted by the same reference numerals, as necessary, and a description thereof will be omitted or simplified.

Figure 3:
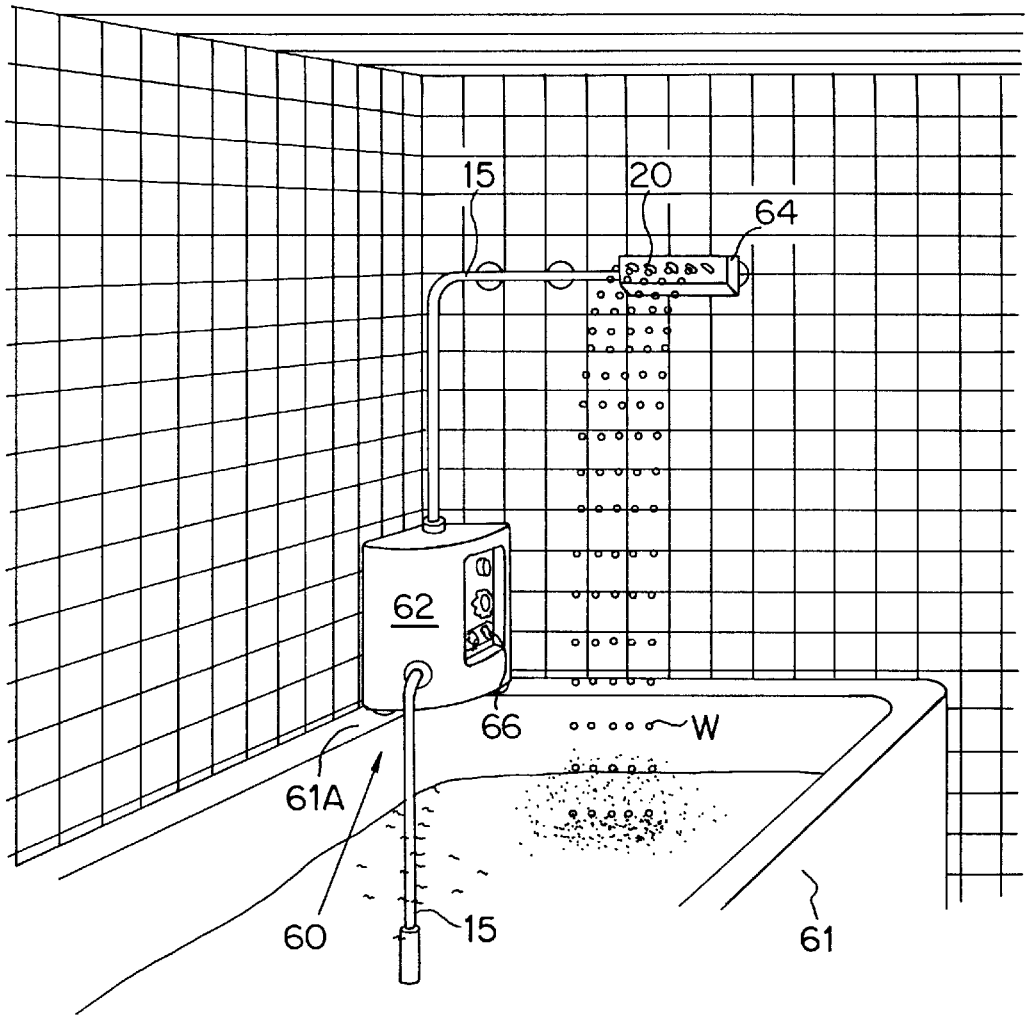
FIG. 3 is a schematic diagram illustrating a second embodiment of the fountain apparatus.

FIG. 3 shows a second embodiment in accordance with the present invention. In this embodiment, the fountain apparatus 10 in the above-described first embodiment is basically used, and is designed as a fountain apparatus 60 for use in a bath room. An apparatus body 62 is on an edge 61A at a corner of a bath tub 61, and the water passage pipe 15 which is suspended downward and the water passage pipe 15 which extends upward are disposed on the apparatus body 62. A nozzle supporting member 64 serving as a water distributing member which performs a function equivalent to that of the nozzle tank 50 equipped with the nozzles 20 is fixed at a distal end of the upper water passage pipe 15. Although not illustrated in the drawing, the pump 15 and the vibration imparting means 18 described above are mounted in the apparatus body 62. In addition, on-off control of these members can be effected by a dialing operation or the like of an operation unit 66 disposed on the surface side of the apparatus body 62. The other arrangements are substantially identical to those of the above-described first embodiment.

Accordingly, in accordance with such an embodiment, it is possible to provide an advantage similar to that of allowing one's shoulders and back to be pelted with water dropping from high above. Consequently, one is able to enjoy a bath. Incidentally, in a case where ddd with an 8-mm diameter are allowed to drop from a 1-mm height, the maximum impact can be calculated as $$F=p\pi r^2=9.8\times10^3\times\pi\times0.004^2=0.49N=50g \text{ weight}$$

Meanwhile, in a case where water of an equal amount is allowed to drop continuously, the maximum impact can be calculated as $$F=pS=\rho v^2/2\times50m/\rho v/2=0.3N=3g \text{ weight}$$

Accordingly, in accordance with the second embodiment, when the ddd W collide against the human body, the ddd W splash hard, with the result that it is possible to expect the effect of allowing one's shoulders and back to be pelted with water dropping from high above.

Figure 4:
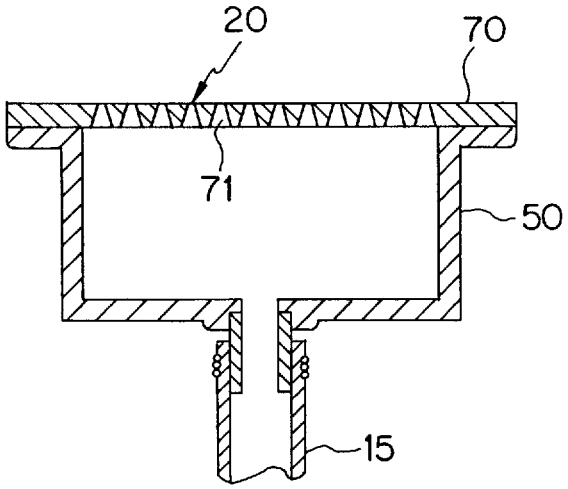
FIG. 4 is a cross-sectional view illustrating a modification of the nozzles.
Figure 5:
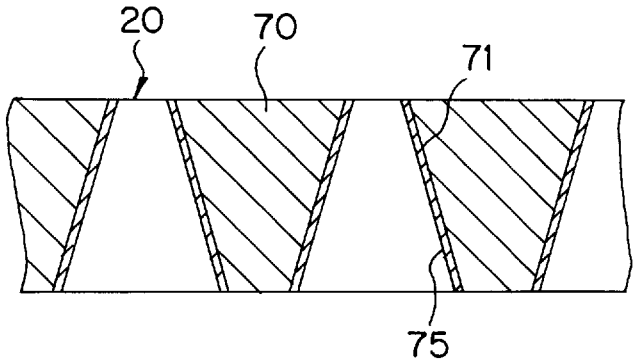
FIG. 5 is a partial enlarged view of FIG. 4.

It should be noted that a construction shown in FIG. 4 can be adopted for the nozzles 20 in accordance with the first and second embodiments. These nozzles 20 are constructed such that a nozzle plate 70 is formed at an upper end of the nozzle tank 50 serving as the water distributing member, holes 71 whose aperture is gradually throttled are formed in the nozzle plate 70, and resin-made nozzles 75 are fitted in the holes 71, as shown in FIG. 5. Such a modified structure makes it possible to obtain the operation and effect similar to those described above, and the overall nozzles can be formed as a simplified integrated structure.

Figure 6:
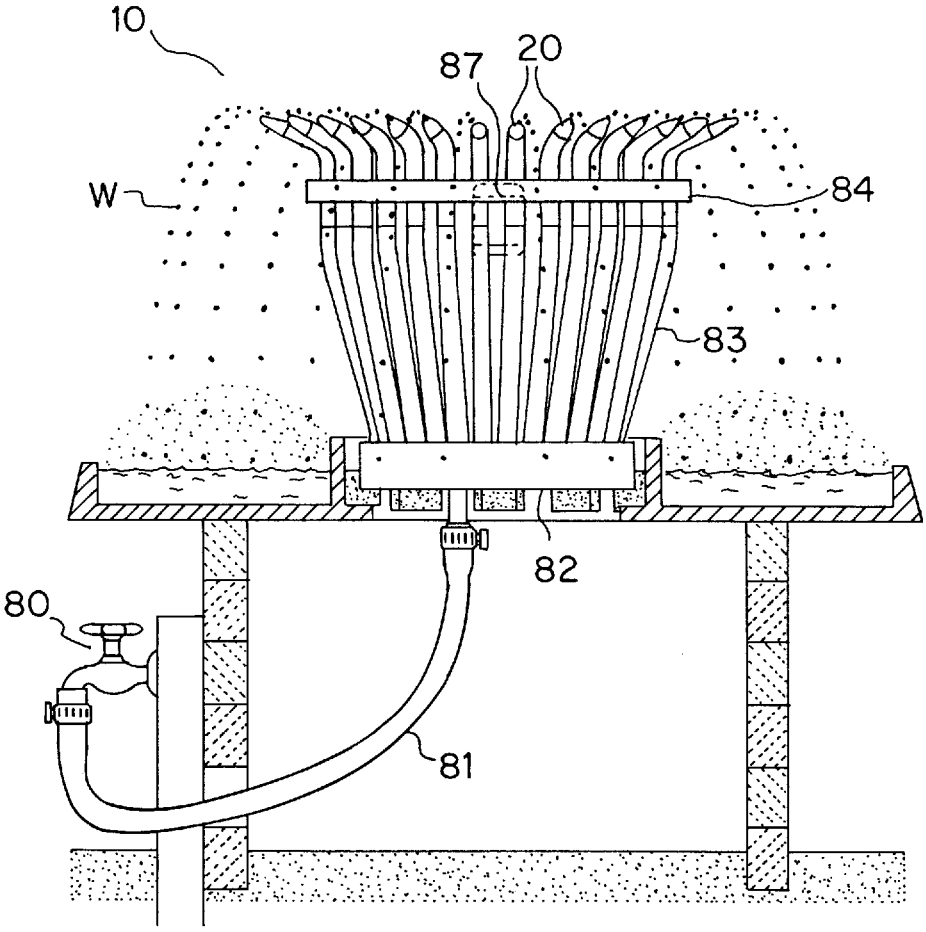
FIG. 6 is a schematic front elevational view illustrating a third embodiment of the present invention.

FIG. 6 shows a third embodiment of the fountain apparatus in accordance with the present invention. In the drawing, one end of a hose 81 is connected to a faucet 80 serving as the source of water supply, and the other end of the hose 81 is connected to a tank 82 serving as the water distributing member. A nozzle supporting member 84 is provided at a position above the tank 82 by means of an unillustrated fixing member. Proximal portions of the nozzles 20 projecting downward from a lower surface of the nozzle supporting member 84 and the tank 82 are connected to each other by means of a plurality of hoses 83. Here, a vibrator unit 87 constituting the vibration imparting means is fixed to the supporting member 84, as indicated by the dotted lines in FIG. 6. The vibrator unit 87 can vibrate with a frequency in a range of 30 Hz to 100 Hz in the same way as in the above-described embodiments. Accordingly, in this embodiment, the arrangement provided is such that the vibrator unit 87 is fixed to the nozzles 20 by means of the supporting member 84. Incidentally, although not shown here, the multi-strobe 21 or the like which is used in the first embodiment is also used.

In such an arrangement as well, the vibrations of the vibrator unit 87 are transmitter to the flowing water, and the ddd W similar to those of the foregoing embodiments can spout.

Accordingly, in this third embodiment, the structure of the vibration imparting means is made very simple so that it is possible to obtain advantages in that a substantial reduction can be made in the manufacturing cost through a reduction in the number of component parts used, and that the execution of work of the fountain apparatus as a whole can be facilitated.

Figure 7:
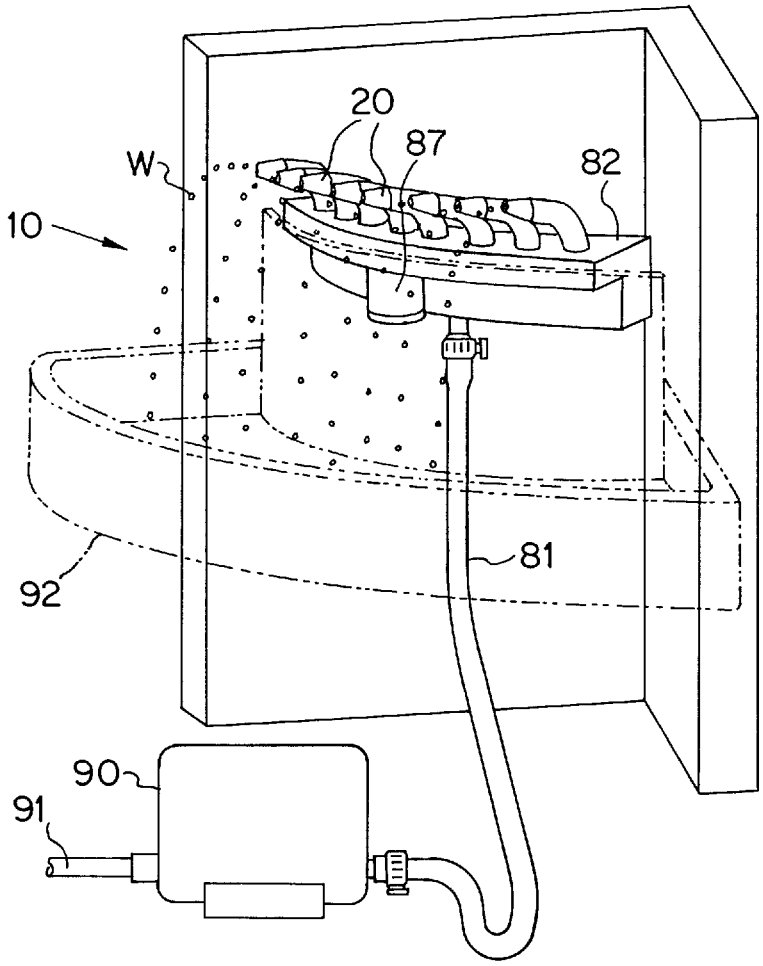
FIG. 7 is schematic perspective view illustrating a fourth embodiment of the present invention.

FIG. 7 shows a fourth embodiment of the fountain apparatus in accordance with the present invention. The structure of this fourth embodiment is basically similar to that of the third embodiment except that, instead of the faucet 80, a pump 90 is used to permit the supply of water, and the nozzles 20 and the vibrator unit 87 are connected to the tank 82 serving as the water distributing member. Here, a circulating pipe 91 is connected to the pump 90, and the other end of the circulating pipe 91 is connected to a water storage section 92 into which the drops of water W fall. Furthermore, it is possible to adopt an arrangement in which a water purifier or the like is interposed in the circulating pipe 91, as necessary.

Accordingly, in accordance with such a fourth embodiment as well, it is possible to allow similar ddd W to spout, and in supporting the nozzles 20 the nozzle supporting member 84 used in the third embodiment can be omitted to attain the simplification of the structure.

Figure 8:
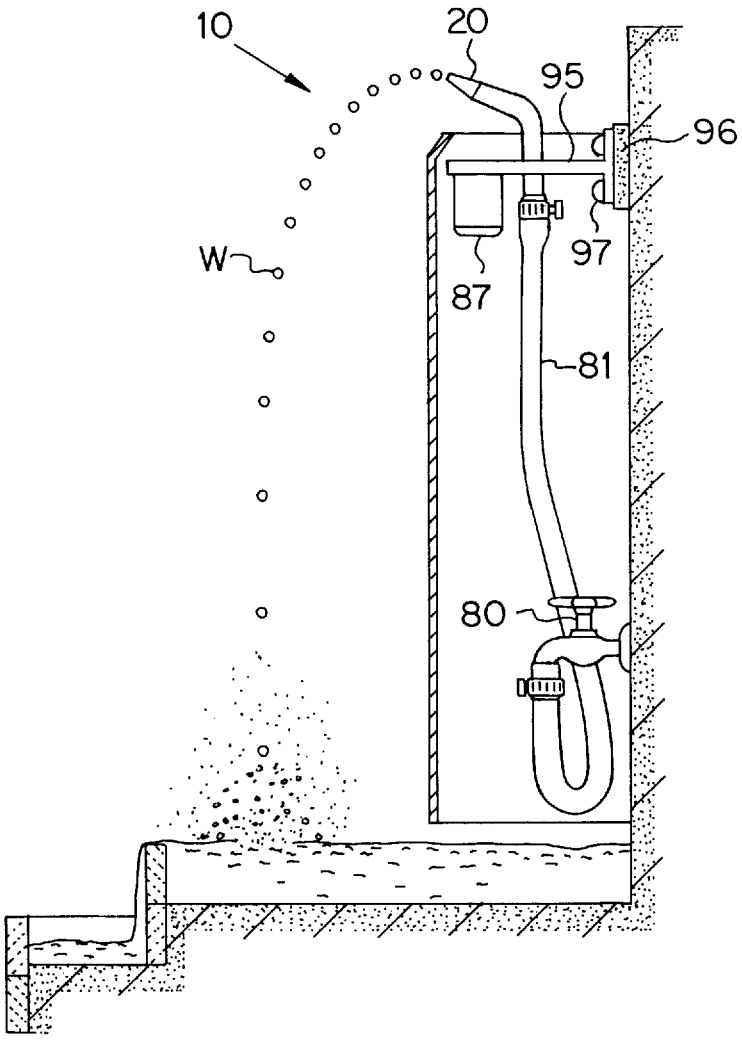
FIG. 8 is a side elevational view illustrating a fifth embodiment of the present invention.

FIG. 8 shows a fifth embodiment. This embodiment is configured by using a single nozzle 20, and is arranged such that the vibrator unit 87 is fixed to a plate-like frame 95 for supporting the proximal side of the nozzle 20 so as to impart the vibrations. Here, the frame 95 is secured to a wall surface by means of bolts 97 through rubber 96.

Accordingly, in accordance with such a fifth embodiment as well, it is possible to obtain the operation and effect similar to those of the above-described embodiments. Further, the arrangement in accordance with the fifth embodiment is provided with a simpler structure as compared with the already-described arrangements, and it is possible to provide a fountain apparatus at low cost.

Incidentally, although in the third to fifth embodiments an example is shown in which the vibrator unit 87 is indirectly fixed or connected to the nozzle(s) 20, it is possible to adopt an arrangement in which the vibrator unit 87 and the nozzles 20 directly abut against and are connected to each other. In addition, the ddd W can be similarly produced even if the vibrator unit 87 is directly or indirectly connected to the hoses 81 and 83. In this case, in a case where a plurality of hoses 83 are used as shown in FIG. 6, if the hoses 83 are bundled together by such as an annular member or the like and the single vibrator unit 87 is secured to the annular member or the like, it is possible to transmit vibrations to the water flowing in all the hoses 83. Alternatively, a plurality of vibrators unit 87 may be respectively connected to the individual hoses 83, and if the frequencies of the vibrators unit 87 are made different appropriately, it is possible to vary the diameters of the ddd W spouting from the respective nozzles 20, and the stationary, dropping, and rising states of the drops of water can be varied for each nozzle 20. In short, various modifications in design are possible in the present invention insofar as vibrations can be imparted to the water flowing through the nozzles 20 or the hoses 81 and 83.

In addition, as for the light from the multi-strobe 21, it is possible to adopt an arrangement in which the light is applied after being transmitted through the same type or a plurality of different types of color film, so as to impart a color or various colors to the ddd W. Further, is is also possible to use one or more optical fibers or the like instead of using the multi-strobe 21. In this case, if an arrangement is adopted in which the light-projecting portions of the optical fibers are regularly opened or closed, it is possible to virtually produce an effect similar to that of the multi-strobe 21.

Further, the dimensions of the respective parts, the number of nozzles 20, and the like of the fountain apparatus 10 in the present invention are arbitrary, and may be varied in accordance with its scale corresponding to the location where the fountain apparatus 10 is used and other requirements.

Since the fountain apparatus 10 in accordance with the present invention is arranged and operates as described above, the diaphragm can be constantly vibrated stably and reliably, and the distance from the vibration imparting means to the nozzles can be set to be long, making it possible to realize various forms of use. At the same time, it is possible to simplify the structure of the vibration imparting means as compared with the conventional structure, and vibrations can be imparted reliably.

In addition, in a case where the arrangement is adopted in which the vibrator constituting the vibration imparting means is directly or indirectly connected to the nozzles or hoses, the structure of the fountain apparatus can be further simplified, and the cost of execution of work of the fountain apparatus can be reduced, so that it is possible to provide an inexpensive, popular-type fountain apparatus.

What is claimed is:

1. A fountain apparatus comprising:

a vibration imparting arrangement for imparting vibrations to flowing water, said vibration imparting arrangement including a tank which forms a single chamber, a diaphragm disposed at a part of said tank, and a vibrator unit connected to said diaphragm and adapted to impart vibrations of a predetermined frequency, ranging from 30 to 100 Hz, to said diaphragm, said vibrator unit being separable from said diaphragm; and at least one nozzle including a tip for spouting the flowing water subjected to vibrations, imparted by the vibrator unit to said diaphragm, in the form of droplets further comprising:

a water distributing member, in fluid communication with a source of water, disposed at a proximal end of said at least one nozzle; and a hose interposed between said water distributing member and each at least one nozzle.

2. A fountain apparatus according to claim 1, wherein said diaphragm is formed by a resin or metal plate having a thickness ranging from 0.5 mm to 5 mm.

3. A fountain apparatus according to claim 1, wherein said vibrator unit is suspended from said diaphragm.

4. A fountain apparatus comprising:

vibration imparting arrangement, including a vibrator unit, for imparting vibrations to flowing water at a frequency ranging from 30 to 100 Hz; and at least one nozzle including a tip for spouting the flowing water, subject to vibrations imparted by said vibration imparting arrangement, in the form of, droplets:

wherein said vibrator unit is connected to said at least one nozzle further comprising:

at least one hose having a first end and a second end, said first end being attached to a proximal end of said at least one nozzle; and a water distributing member, in fluid communication with a source of water, attached to the second end of each at least one hose.

5. A fountain apparatus according to claim 4, wherein the tip of said at least one nozzles contains an aperture having a diameter ranging from 3 mm to 20 mm.

6. A fountain apparatus comprising:

vibration imparting arrangement, including a vibrator unit, for imparting vibrations to flowing water at a frequency ranging from 30 to 100 Hz; and at least one nozzle including a tip for spouting the flowing water, subject to vibrations imparted by said vibration imparting arrangement, in the form of, droplets:

wherein said vibrator unit is connected to said at least one nozzle, further comprising a hose connected to a proximal end of each at least one nozzles, and wherein said vibrator unit is connected to said hose.

* * * * *